United States Patent [19]

Stadelhofer et al.

[11] 4,259,171

[45] Mar. 31, 1981

[54] PROCESS FOR THE SEPARATION OF QUINOLINE-INSOLUBLE COMPONENTS FROM COAL TAR PITCH

[75] Inventors: Jürgen Stadelhofer, Dortmund; Gerd Collin, Duisburg, both of Fed. Rep. of Germany

[73] Assignee: Rütgerswerke Aktiengesellschaft, Frankfurt, Fed. Rep. of Germany

[21] Appl. No.: 15,985

[22] Filed: Feb. 28, 1979

[30] Foreign Application Priority Data

Mar. 10, 1978 [DE] Fed. Rep. of Germany ..... 2810332

[51] Int. Cl.[3] ..... C10C 1/18

[52] U.S. Cl. ..... 208/45; 208/309

[58] Field of Search ..... 208/45, 309

[56] References Cited

U.S. PATENT DOCUMENTS

| | | | |
|---|---|---|---|
| 4,055,583 | 10/1977 | Kölling et al. | 208/45 |
| 4,127,472 | 11/1978 | Migitaka et al. | 208/45 |

*Primary Examiner*—Veronica O'Keefe

*Attorney, Agent, or Firm*—Beveridge, Degrandi, Kline and Lunsford

[57] ABSTRACT

Quinoline-insoluble components are separated from coal tar pitch by treating the coal tar pitch which has a softening point of greater than 60° C. (according to the method of Kraemer-Sarnow) with a solvent mixture comprising at least one solvent with paraffinic characteristics and at least one tar solvent, wherein the treatment is carried out at a temperature in the range of 200° to 270° C.

6 Claims, No Drawings

PROCESS FOR THE SEPARATION OF QUINOLINE-INSOLUBLE COMPONENTS FROM COAL TAR PITCH

The invention relates to a process for the separation of quinoline-insoluble components from coal tar pitch.

In the distillation of coal tar, one of the most important chemical raw materials, coal tar pitch is obtained in a quantity of 50–55%. There are numerous possibilities for the use of coal tar pitch. For certain areas of application, for example, for the production of a high grade pitch products, such as carbon fibers or "needle coke", the pitch must have certain characteristics; especially required for this purpose is a very low content of so-called $\alpha$-resins, that is to say the components of the pitch which are insoluble in quinoline. In order to reduce the QI content (QI=components insoluble in quinoline) of pitches, various separating processes, such as for example mechanical separation by filtration or centrifuging or distillation processes, have been developed (see for example, German Pat. No. 1,189,517, especially col. 1, line 49 ff.). According to the mechanical separation processes, the pitch is dissolved preferably in a tar solvent at an elevated temperature and the insoluble components are separated by mechanical methods.

However, these known processes are extremely expensive, subject to breakdowns and especially in the case of a distillation separation connected with very great losses.

It is a feature of the present invention to provide a process for the separation of components insoluble in quinoline by treating the pitch with an organic solvent and separating the insoluble components, which process avoids the disadvantages of the known processes and beyond that makes possible a largely selective separation of the QI-components. This task is solved by the process according to the invention which is characterized in that a coal tar pitch with a softening point of > 60° C. (according to Kraemer-Sarnow) is treated with a solvent mixture of at least one solvent with paraffinic characteristics and at least one tar solvent, at temperatures between 200°–270° C.

A solvent with paraffinic characteristics as used according to the invention, is intended to mean a solvent, which is characterized by the so-called K-factor, with a very high value, as described by Watson (see Watson, Nelson, Ind. Eng. Chem. 25 [1933]880). The K-factor represents a measure for the aromatic and paraffinic characteristics of the solvent whereby particularly good results are obtained with a K-factor > 10.5. Suitable solvents are especially aliphatic and cycloaliphatic hydrocarbons which are characteristized by a low density (0.66–0.89) with a relatively high boiling end point (preferably up to about 260° C.), as for example, n-hexane, Decalin, kerosene of boiling point 210°–260° C., hexadecane or cetene. The upper limit for the K-factor is not critical for purposes of this invention.

A tar solvent as used in the present invention is intended to mean a solvent the aromatic solvent characteristics of which are paramount. Therefore, preferably aromatic solvents are used, particularly those obtainable from coal tar or petroleum fractions. Such solvents are, for example, anthracene, naphthalene and their methyl homologues, as well as residual oils from cracking reactions of petroleum fractions rich in aromatics or especially from coal tar distillate fractions, such as wash oil, naphthalene oil, anthracene oil, debased and dephenolized light oil or cuts from it.

The mixture of solvents used according to the invention may consist of one each of the above types, or several solvents of each type. The mixing ratio of the two types of solvents may be varied within wide limits; preferably the ratio of paraffinic solvent to tar solvent is from 0.2 to 1 up to and including 3 to 1, and especially 1:2 to 2:1. It may also be effective for the process of the present invention, for example, for recapturing and reusing of the solvents or else for the increase of the coke yield to use solvents with sufficiently variable boiling ranges for the mixture of solvents.

The ratio of pitch used to the solvent ranges generally from 1:5 to 3:1, preferably from 1:2 to 2:1. Effectively the ratio is selected at the same time such that for achieving good results, as little solvent as possible is required. It is determined especially also by the mixing ratio of the two solvent components.

The treatment of the pitch with the mixture of solvents is accomplished at a temperature ranging from 200° to 270° . The treatment may take place at atmospheric pressure or under a slightly excess pressure (up to about 10 bar). Preferably, the treatment takes place in several hours, for example, 1 to 3 hours of good mixing of the components, e.g. by stirring or in the shaking autoclave.

A coal tar pitch with a softening point of > 60° C. (KS) is a medium or hard pitch, for example, a pitch with a softening point of 75° C.

The separation of the QI-components may take place according to one of the known mechanical separating processes in a continuous or discontinuous manner, as for example, by centrifuging, filtering, accelerated gravity deposit with separators or preferably by a simple gravity settler. The separation effectively is accomplished at a lower temperature (for example, preferably 20°–70° lowered) than the treatment temperature, therefore, preferably for example at 160°–200° C.

The pitch may be mixed directly with the mixture of solvents. However, one may also proceed in such a way that the pitch is first treated with the tar solvent at an elevated temperature and the paraffinic solvent is added only prior to the separation of the QI-components.

According to the process of the invention, one succeeds in obtaining pitches at high yields (about 75–90%) from which the $\alpha$-resins are largely and selectively removed (QI-content < 0.3%) without the $\beta$-resins (= content of components soluble in quinoline, insoluble in toluene) will be excessively reduced at the same time, despite the high content of the starting pitches of toluene insoluble components (TI). Furthermore, the process according to the invention has the advantage that the largely selective separation of the $\alpha$-resins will succeed with good results, especially in view of the duration of the process and selectivity, in an inexpensive manner even by simple gravity deposit. According to the process of the invention, it is thus possible to obtain a pitch with an essentially uniform share of $\beta$-resin and with a very small share of $\alpha$-resins (QI) as desired for many purposes, for example, for the production of needle coke.

As the subsequent example given by way of comparison shows, these results which may be achieved with the process according to the invention, will not be achieved whenever one uses one of the hitherto customary tar solvents, the method of the process remaining the same, even in the case of much longer separating times.

If not stated otherwise, preceding and succeeding ratio and percentage data relate to parts by weight or percent by weight, temperatures relate to degrees centigrade and data for the boiling point relate to 1 bar pressure. SP designates the softening point (according to Kraemer-Sarnow = KS), TI = toluene-insoluble components, β-resins = TI - QI.

EXAMPLE 1

The pitch used had a QI content of 5.1%, the TI content amounted to 21.7%; β-resin content: 16.6%, SP (K.S.) 75° C.

200 g. of pitch are treated with 90 g. of kerosine and 90 g. of a methyl naphthalene fraction poor in naphthalene (boiling point 235°–245° C.) for 3 hours at 250°±3° C. in the shaking autoclave. During this time, a pressure of 2.1 bar is built up. After a gravity settling time of 1 hour at 180° C., the mixture with little QI standing above the bottom deposit formed, is drawn off. In order to obtain a fluid residue, only 80% of the total material is drawn off. There remains a residue in the autoclave of barely 20%. The solvents used may be recaptured by distillation because of the great boiling gap between pitch and solvent.

The yield of pitch amounts to 150 g. (75%) of the pitch used. The mixture of solvent is recaptured at 85%. (At the same time, a possible recapture from the residue rich in QI has not been taken into consideration.) The pitch obtained in that way (SP (K.S.) 64° C.) has a QI content of 0.08 and a TI content of 14.7, β-resin content of 14.6%.

EXAMPLE 2:

The pitch used had a QI content of 3.5%; The TI content amounted to 19.8; β-resin content: 16.3%, SP (K.S.) 75° C.

One operates as in Example 1 with the use of kerosine and heavy benzole (boiling range 190°–200° C.) 200 g. of coal tar pitch are used, 83 g. of kerosine and 83 g. of heavy benzole (1/0.415/0.415).

The yield of pitch amounts to 90% (related to the total use of pitch). Kerosine and heavy gasoline are recaptured as a mixture at 85%.

The pitch obtained in this way is characterized as follows: SP (K.S.): 56° C., QI content: 0.1%; TI content 13.0%, β-resin content: 12.9%.

EXAMPLE 3 (Comparative Example):

One operates as in Example 1, but without the addition of kerosine.

Used:

200 g. of pitch 180 g. of methyl napthalene fraction poor in naphthalene.

After a settling time of 3–4 hours, no bottom sediment is formed. After separation of the upper part of the mixture (80% total quantity), a pitch with a QI content of 3.2% is obtained.

Further modification of the present invention will be apparent to those skilled in the art and are intended to be encompassed by the following claims.

We claim:

1. In a process for the separation of quinoline-insoluble components wherein coal tar pitch is treated with an organic solvent and the insoluble components are thereafter separated, the improvement which comprises selecting a coal tar pitch with a softening point of greater than 60° C. (according to Kraemer-Sarnow) and treating said pitch with a solvent mixture comprising a paraffinic solvent selected from the group consisting of aliphatic and cyclo-aliphatic hydrocarbon solvents and a tar solvent which is an aromatic solvent obtainable from coal tar or petroleum fractions, at temperatures of 200° to 270° C. wherein the ratio of paraffinic solvent to tar solvent ranges from 0.2 to 1 and up to 3 to 1 and wherein the separation takes place at a temperature between 160° and 200° C.

2. The process as in claim 1, wherein said ratio ranges from 1 to 2 up to 2 to 1.

3. The process as in claim 1 or 2, wherein the ratio of pitch used to the solvent ranges from 1:5 to 3:1.

4. The process as in claim 1 or 2 wherein the ratio of pitch used to the solvent ranges from 1:2 to 2:1.

5. The process as in one of the claims 1 or 2, wherein the separation of the quinoline-insoluble components is accomplished by simply gravity deposit.

6. The process as in one of the claims 1 or 2, wherein the separation takes place at a lower temperature than the processing temperature.

* * * * *